US006926423B2

(12) United States Patent
Bucher et al.

(10) Patent No.: US 6,926,423 B2
(45) Date of Patent: Aug. 9, 2005

(54) LIGHT WITH SIMULATED CANDLE FLICKER

(75) Inventors: John C. Bucher, Ft. Lauderdale, FL (US); Charles E. Bucher, Valrico, FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 10/613,918

(22) Filed: Jul. 3, 2003

(65) Prior Publication Data

US 2005/0002188 A1 Jan. 6, 2005

(51) Int. Cl.[7] ..... F21V 33/00

(52) U.S. Cl. ..... 362/184; 362/252; 362/800; 362/806; 362/810

(58) Field of Search ..... 362/184, 208, 362/252, 800, 806, 810

(56) References Cited

U.S. PATENT DOCUMENTS

| | | | | | |
|---|---|---|---|---|---|
| 4,510,556 | A | | 4/1985 | Johnson | 362/184 |
| 4,593,232 | A | | 6/1986 | McEdwards | 315/199 |
| 4,839,780 | A | | 6/1989 | Chuan et al. | 362/265 |
| 5,013,972 | A | * | 5/1991 | Malkieli et al. | 315/209 R |
| 5,097,180 | A | | 3/1992 | Ignon et al. | 315/200 |
| 5,600,209 | A | * | 2/1997 | St. Louis | 315/200 A |
| 5,924,784 | A | * | 7/1999 | Chliwnyj et al. | 362/234 |
| 6,066,924 | A | * | 5/2000 | Lederer | 315/185 R |
| 6,198,229 | B1 | | 3/2001 | McCloud et al. | 315/185 |
| 6,719,443 | B2 | * | 4/2004 | Gutstein et al. | 362/392 |

* cited by examiner

*Primary Examiner*—Laura K. Tso
(74) *Attorney, Agent, or Firm*—Holland & Knight LLP

(57) ABSTRACT

A device and system for simulating the flicker of candle flame is provided by the present invention. A series of independent charging and discharging circuits are provided that produce power waveforms having duty cycles that vary from a highest duty cycle to a lowest duty cycle. The power waveforms are provided to a series of LEDs arranged in a vertical stack. The lowest duty cycle power waveform is provided to the highest LED in the stack and the highest duty cycle power waveform is provided to the lowest LED in the stack. An approximately flame shaped housing that is partially translucent is positioned around the vertical stack of LEDs such that the light from the LEDs is visible while the LEDs themselves are not. A solar panel and an associated rechargeable battery are used to power the device.

29 Claims, 5 Drawing Sheets

LIGHT WITH SIMULATED CANDLE FLICKER

FIELD OF THE INVENTION

This invention generally relates to the field of lighting. More particularly, the present invention is directed toward a light that simulates the flickering of the flame of a candle.

BACKGROUND OF THE INVENTION

Presently, there are a number of different lighting systems for simulating the light produced by a burning object such as a candle flame. Unfortunately, many of these devices fail to produce a realistic flickering light. Furthermore, the prior art devices tend to be costly to construct or unreliable to operate. Therefore, it is an object of this invention to substantially improve upon the prior art by providing an improved lighting device and process for producing a realistic, candle-like flickering light that is inexpensive to construct and reliable and efficient to operate.

Therefore, it is an object of this invention to provide an improvement which overcomes the aforementioned inadequacies of the prior art devices and provides an improvement which is a significant contribution to the advancement of the simulated candle lighting art.

Another object of the invention is to provide a device for producing a light having a candle like flicker wherein the device includes a first light source oscillating between an off and an on state and a second light source oscillating between and on and an off state and the oscillation of the first light source is independent of the oscillation of the second light source.

Another object of the invention is to provide a device for producing a light having a candle like flicker that includes a first light source that is in a visibly on state, a second light source visibly oscillating between an on and an off state, and a third light source visibly oscillating between an on and an off state wherein the oscillation of the second light source is independent of the oscillation of the third light source.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

A preferred embodiment of the present invention is directed toward a lighting device for producing a light that simulates the flicker of a candle flame. The lighting device includes at least a first, second and third light source. The light sources are arranged in a vertical stack such that the first light source is lower in the vertical stack than the second light source and the second light source is lower in the vertical stack than the third light source. A power circuit associated with each of the light sources produces a power signal for its associated light source. The duty cycle of the power signal provided to the first light source is greater than the duty cycle of the power signal provided to the second light source. Most preferably, the duty cycle of the power signal provided to the first light source is such that the first light source is always on. The duty cycle of the power signal provided to the third light source is less than the duty cycle of the power signal provided to the second light source. Preferably, the duty cycle and frequency of each power signal is independent of the duty cycle and frequency of the other power signals. In addition, the power circuits for the second and third light sources include a resistor and a capacitor such that a resistance value of the resistor and a capacitance value of the capacitor determine the frequency at which the power signal produced by the respective power circuit oscillates. The power circuits for the second and third light sources further include a diode that alters the duty cycle of the power signals produced by the power circuits. A semi-transparent housing encloses the light sources such that the light from the light sources is visible but the individual light sources themselves are not. A light sensor preferably turns the lighting device on when an intensity of the light detected by the light sensor falls below a predetermined level. The lighting device is also preferably powered by a solar battery that is recharged by a solar power source.

Another embodiment of the present invention is directed toward a light that produces a light having a candle-like flicker. The light includes a first light source positioned at a bottom of a vertical stack. A second light source is positioned in the vertical stack above the first light source. A third light source is positioned in the vertical stack above the second light source. Preferably, the first, second and third light sources are light emitting diodes. A first power circuit produces a first power signal and provides the first power signal to the first light source. A second power circuit produces a second power signal having a duty cycle less than the duty cycle of the first power signal and provides the second power signal to the second light source. A third power circuit produces a third power signal having a duty cycle less than the second power signal and provides the third power signal to the third light source. The second and the third power circuits have at least one resistor and one capacitor. The frequency of the power signal produced by the second and third power circuits is determined at least in part by its respective resistor and capacitor. The second power circuit and the third power circuit further include a diode that alters the duty cycle of the respective power signals produced by the second and third power circuits. Thus, the duty cycle and frequency of the second power signal is independent of the duty cycle and frequency of the third power signal. A translucent housing shaped like a candle flame contains the first, second and third light sources. A solar power panel and an associated rechargeable battery provide power for the light. A light sensor turns the light on when a detected light intensity falls below a predetermined level. The light sensor is shaped or shielded from the light sources so that it is not affected by their operation. The light is preferably contained within an outer housing having a base and a lid. The components of the light are incorporated into the lid and the lid is configured to attach to the top of the base.

Yet another embodiment of the present invention is directed toward a method of producing a light having a candle-like flicker. The method includes the step of arranging multiple light sources into an approximately vertical stack. A relatively high duty cycle power waveform is generated and provided to a lowest light source in the vertical stack. An intermediate duty cycle waveform is generated and provided to a light source positioned in an intermediate location in the vertical stack. A relatively low duty cycle waveform is generated and provided to the highest light source in the vertical stack. An oscillation frequency of the intermediate duty cycle waveform and the relatively low duty cycle waveform is set with a resistive and capacitive circuit. In addition, a diode is used to set a duty cycle of at least one of the waveforms. The duty cycle and frequency of the high duty cycle waveform, the intermediate duty cycle waveform and the low duty cycle waveform are independent of one another. The multiple light sources are housed in a translucent housing such that individual ones of the multiple light sources are not easily distinguishable through the housing. The light is preferably powered with a solar panel and an associated rechargeable battery. The light is turned off if a detected light intensity exceeds a predetermined level.

Yet another embodiment of the present invention is directed toward a device for producing a light having a candle like flicker. The device includes a first light source oscillating between an off and an on state and a second light source oscillating between and on and an off state. The first light source and the second light source are preferably positioned within approximately one half inch of one another. The oscillation of the first light source is independent of the oscillation of the second light source. The independent oscillation of each light source is controlled by charging and discharging an associated resistive and capacitive circuit. A translucent, candle-shaped housing surrounds the light sources. The device is contained within a fixture having a lid and a base. The light sources are attached to the lid and oscillation circuitry is contained in the lid. The lid is adapted to be attached to the top of the base.

The above described apparatus and method substantially improve upon the prior art by providing an inexpensive and reliable way of simulating the flicker of a candle flame. The use of a resistive and capacitive circuit to control the frequency of oscillation of the lights is less expensive than prior methods and allows for the flicker of the light to be easily adjusted for various applications. Furthermore, the use of independently oscillating light sources produces a realistic candle like flicker that varies over time. The use of LEDs is beneficial in that they have extremely low power requirements, eliminate the need for a microcontroller, are inexpensive and last much longer than standard incandescent bulbs. Furthermore, the use of LEDs makes certain embodiments of the present invention particularly well adapted for use in solar powered landscaping lights. Therefore, the present invention is a substantial improvement upon the prior art.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENTS

Figure 1:
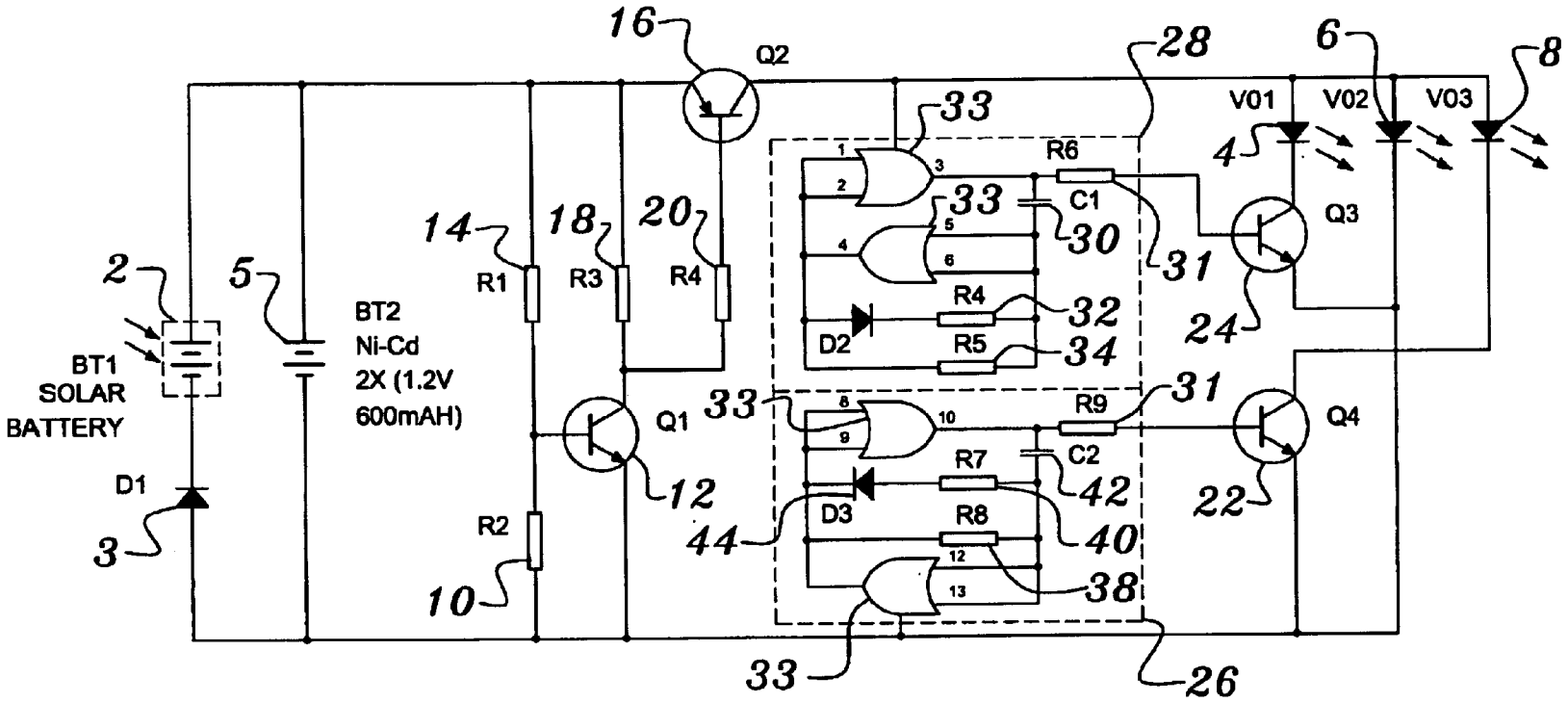
FIG. 1 is a schematic diagram of a flicker light circuit constructed in accordance with a preferred embodiment of the present invention.

Referring now to FIG. 1, a schematic of a candle flicker circuit constructed in accordance with a preferred embodiment of the present invention is shown. The preferred embodiment is powered by a solar panel 2 and an associated rechargeable battery 5. A solar panel 2 and battery 5 are particularly useful when utilizing the present invention in an outdoor application such as landscape lighting as they eliminate the need to run power wires to each of the lights. A diode 3 prevents a reverse current from flowing through the solar panel 2 and battery 5. The solar panel 2 and associated battery 5 are used to provide power to the candle flicker circuit and its three light emitting diodes ("LEDs") 4, 6 and 8. LEDs are preferably used due to their relatively long useful life spans and their low power requirements. However, it will readily appreciated by those skilled in the art in view of the present disclosure that a variety of different types of light sources such as incandescent, etc. could be used in place of the LEDs 4, 6 and 8.

A light sensor 10 is included in the embodiment shown in FIG. 1 to turn on the candle simulating LEDs 4, 6 and 8 when the sensor 10 detects it is dark outside. For best performance, the light sensor 10 is preferably substantially shaded or shielded from the LEDs 4, 6 and 8 such that it does not receive a significant amount of light from the LEDs 4, 6 and 8. When the sensor 10 detects bright light, its resistance becomes very low. The sensor 10 is connected to the base of a transistor 12. Thus, when the resistance of the sensor 10 is low, a large voltage drop is induced across the resistor 14 and the voltage at the base of the transistor 12 drops to a level that turns the transistor 12 off. When the light sensor 10 detects a drop in the light level below a predetermined amount, the resistance of the light sensor goes up and the transistor 12 is turned on.

When transistor 12 turns on, current flows through resistors 18 and 20 thereby turning on the transistor 16. The base voltage of the transistor 16 is adjusted by adjusting the value of resistor 20. Transistor 16 provides current to the LEDs 4, 6 and 8. LED 6 is always on when the transistor 16 is turned on. However, LEDs 4 and 8 are only turned on when their respective transistors 22 and 24 are turned on. Each transistor 22 and 24 is respectively turned on and off by its associated activation circuit 26 or 28. The resistors 31 are used to set the voltages on the base of transistors 22 and 24. The capacitor 30, resistor 32 and resistor 34 are the oscillation components of the charging circuit 28. Adjusting the resistance and capacitance values of the oscillation components 30, 32 and 34 adjusts the frequency of the LED 4. The diode 36 separates the charging and discharging portions of the activation circuit 28 such that the duty cycle of the LED 4 is varied. The or-gates 33 are used as buffers to limit the current flow through the paths into which they are placed. In a similar fashion, resistors 38 and 40 and capacitor 42 are used to set the oscillation frequency of the charging circuit 26 and, thus, LED 8. The diode 44 is used to adjust the duty cycle of LED 8. The activation circuits 26 and 28 are preferably constructed such that the LEDs 4 and 8 flicker on and off and such that the duty cycle of one of the LEDs 4 and 8 is greater than the other. The LEDs 4, 6 and 8 are then arranged in a vertical stack such that the bottom LED is always on and the middle LED oscillates with a duty cycle that is greater than the duty cycle of the top LED. The combination of the vertical stack of LEDs with the top two LEDs oscillating at different frequencies creates a realistic and pleasing candle-like flickering light.

Figure 2:
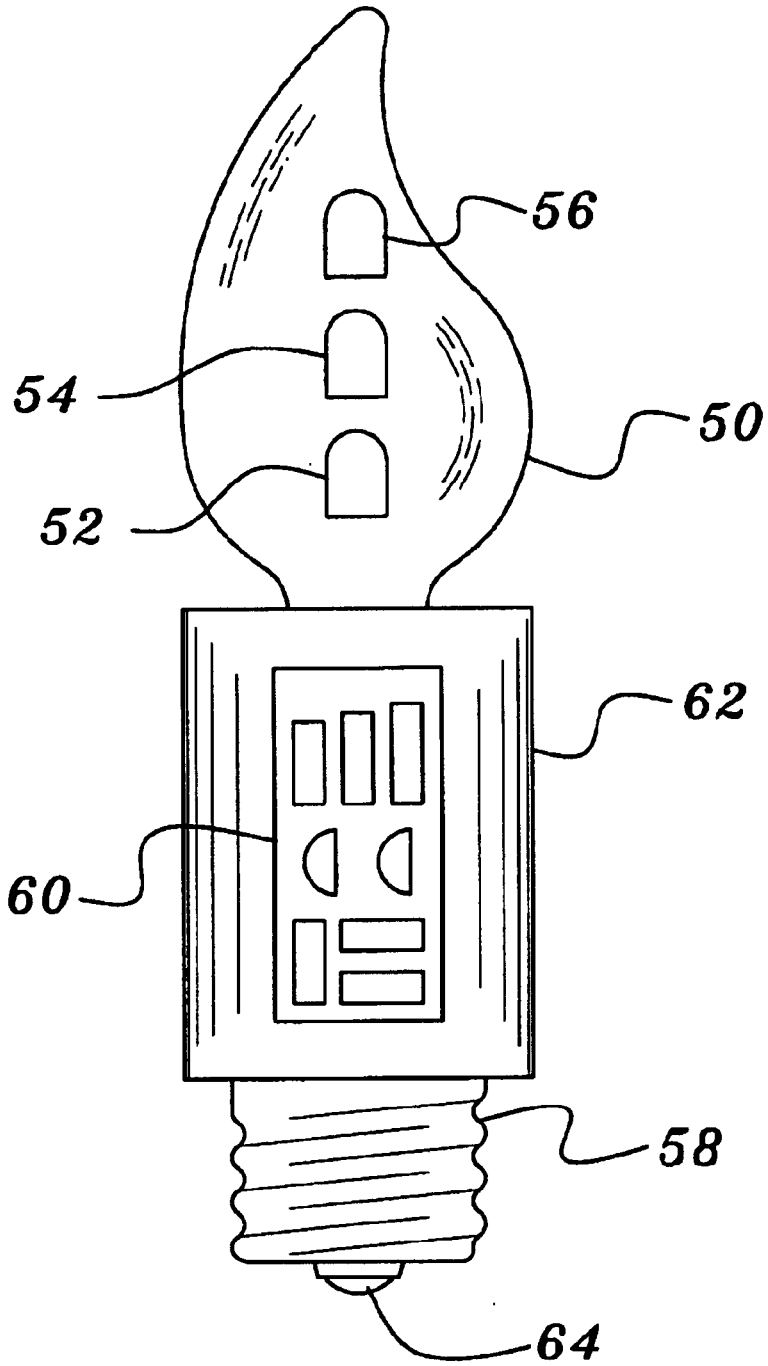
FIG. 2 is a pictorial representation of a preferred embodiment of the present invention.

Referring now to FIG. 2, a preferred embodiment of a housing for the present invention is shown. The housing 50 may be adapted for use with a specialized circuit or to screw into a standard light bulb socket. The exterior of the housing 50 is shaped to approximate a candle flame. The housing 50 is preferably constructed from a transparent material that transmits light but is not clear enough to allow the individual LEDs 52, 54 and 56 contained in the housing 50 to be clearly seen. The LEDs 52, 54 and 56 are arranged in a vertical stack inside of the housing 50. The lowest LED 52 is configured to have the highest duty cycle and the highest LED 56 is configured to have the lowest duty cycle. The electronics that control the LEDs 52, 54 and 56 are preferably placed on a board 60 in the base 62 of the housing 50. Alternatively, the electronics may be remotely located and their control signals provided to the LEDs 52, 54 and 56 through electrical contacts 64 on the base 62 of the housing 50. These electrical contacts 64 may also be used to supply power to the housing 50. Threads 58 are provided on the base 62 such that it can be mounted on a similarly threaded mounting.

Figure 3:
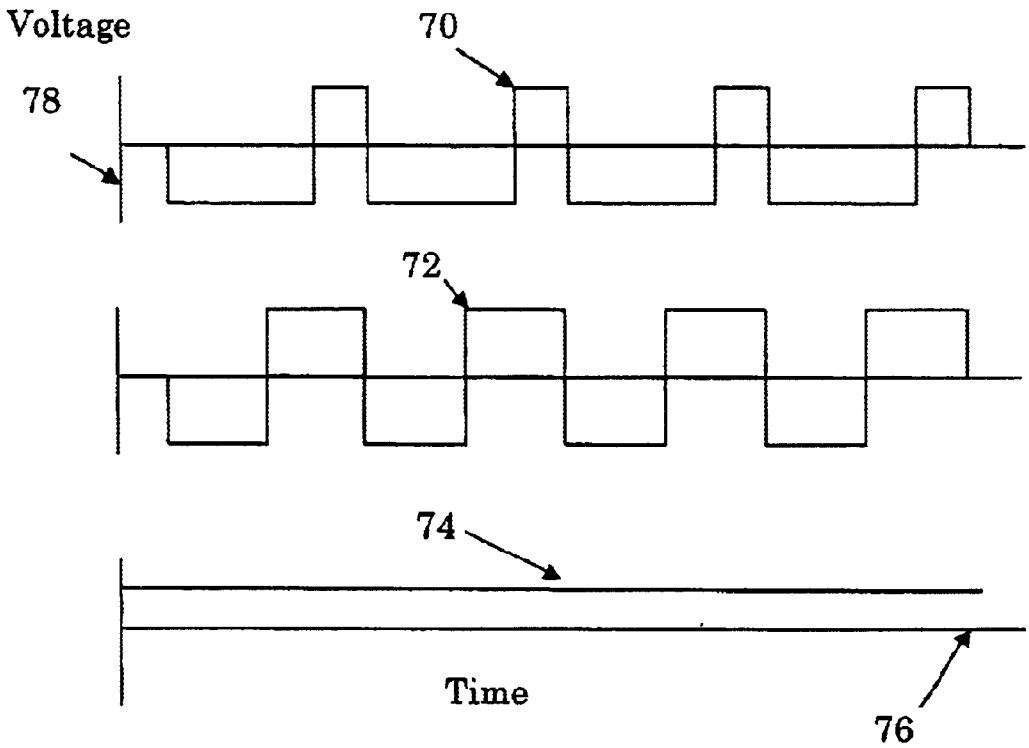
FIG. 3 is a graph of a preferred waveform for activating the LEDs of FIG. 1.

Referring now to FIG. 3, three preferred waveforms for activating the LEDs 52, 54 and 56 depicted in FIG. 2 are shown. The voltage of each waveform 70, 72 and 74 is plotted on the vertical axis 78 and the time is plotted on the horizontal axis 76. The first waveform 70 would be applied to the highest LED 56 on the vertical stack. The waveform 70 is such that it is high enough to turn the LED 56 on when it is above the horizontal axis 76 and will turn the LED 56 off when it is below the horizontal axis 76. Thus, the duty cycle of the first waveform 70 is approximately ⅓ on and, thus, the LED 56 will be lit approximately ⅓ of the time the circuit is activated. The middle LED 54 has a waveform 72 with a duty cycle of approximately ½ on such that it will be on half of the time and off the other half of the time. Finally, the bottom LED 52 has a constant waveform 74 such that it is lit whenever the candle flicker circuit is activated. Thus, the three LEDs 52, 54 and 56 resemble a candle flame in that the bottom is constantly bright while the tip of the flame flickers from a high intensity to a low intensity.

Figure 4:
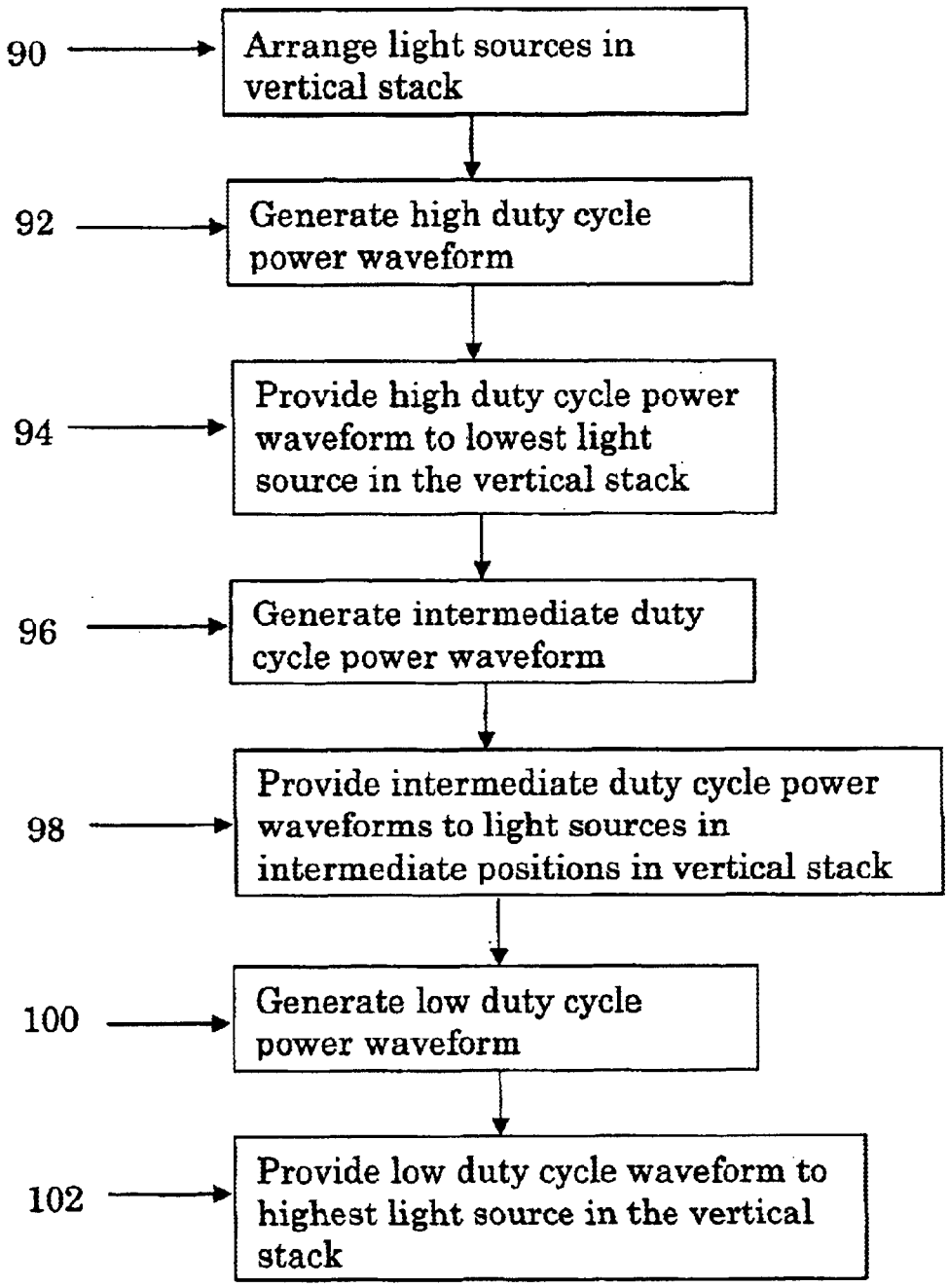
FIG. 4 is a flow chart of a preferred method of simulating the flicker of a candle in accordance with a preferred embodiment of the present invention.

Referring now to FIG. 4, a preferred method of simulating the flicker of a candle is shown. The method commences in block 90 with the step of arranging a series of light sources into a vertical stack. A relatively high duty cycle power waveform is generated in block 92. In block 94, the high duty cycle power waveform is provided as a power signal to the lowest light source in the vertical stack. In block 96, intermediate duty cycle waveforms are generated and, as shown in block 98, the intermediate duty waveforms are provided to light sources positioned in intermediate positions in the vertical stack. Finally, a low duty cycle waveform is generated in block 100 and provided to the highest light source in block 102. The varying duty cycles of the light sources produces a light having a candle-like flicker.

Varying the duty cycle of light sources in a vertical stack such that the lowest light source in the vertical stack has the longest duty cycle and the highest light source in the stack has the lowest duty cycle produces a light that simulates the flicker of a candle. In addition, the use of an LED as described in more detail above provides a long lasting light source that is inexpensive to construct, extremely reliable and has a very low power consumption. Therefore, the present invention is a substantial improvement upon the prior art in that it provides an inexpensive reliable light source that accurately simulates the flicker of a candle light.

Figure 5:
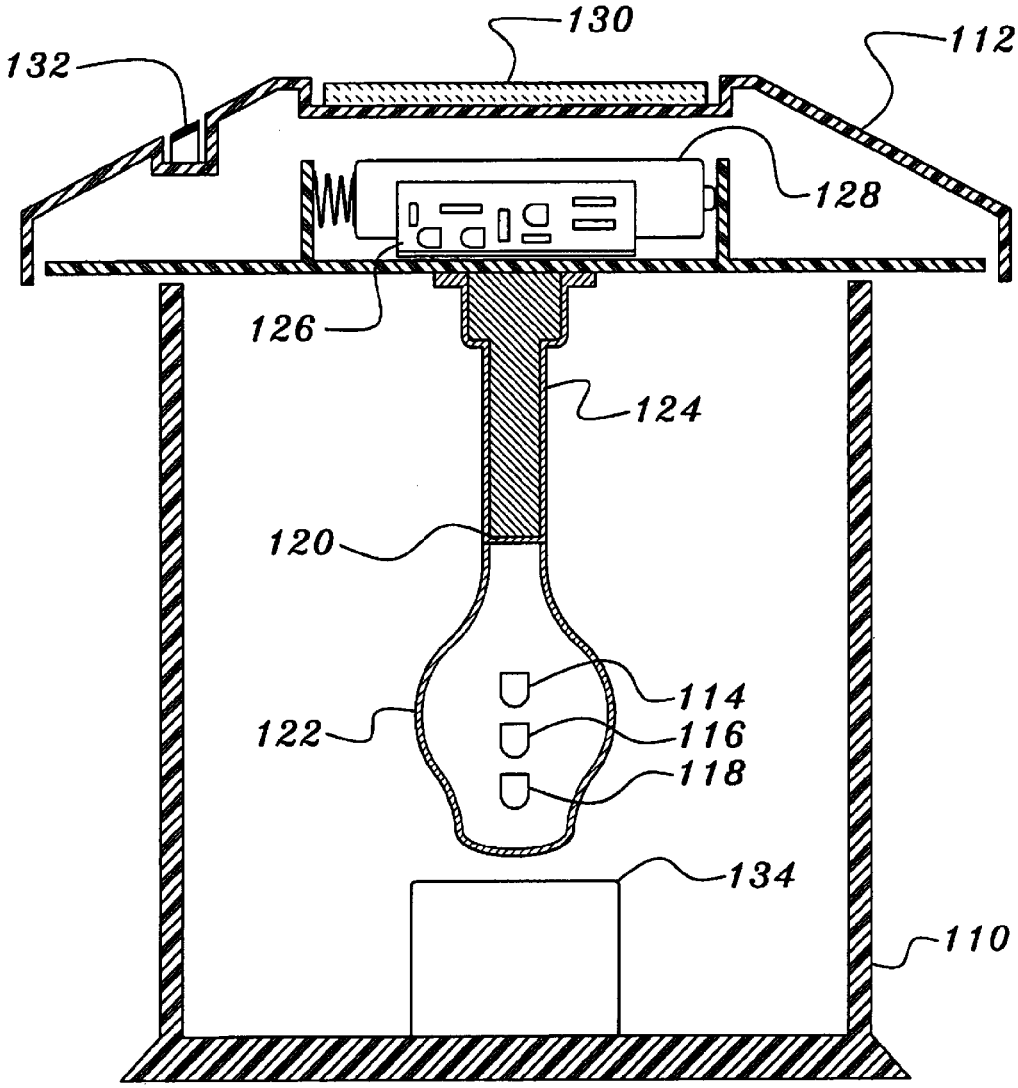
FIG. 5 is a pictorial representation of a preferred embodiment of the present invention having a lamp-shaped outer housing.

Referring now to FIG. 5, another preferred embodiment of the present invention is shown. The embodiment consists of a lamp-like housing having a base 110 and a lid 112. The lid 112 is configured to be attached to the base 110 through a snap-on or twist connection so that the base 110 can be removed to service the internal components. The embodiment utilizes three LEDs 114, 116 and 118. The LEDs 114, 116 and 118 are contained within a housing 120 that extends from the lower surface of the lid 112. The housing 120 has a lower portion 122 that surrounds the LEDs 114, 116 and 118 that is semi-transparent. A member 134 is positioned underneath the lower portion and is connected to the base 110. Enclosing the LEDs within a semi-transparent portion 122 obscures the individual LEDs 114, 116 and 118 and, in conjunction with the flickering of the LEDs 114, 116 and 118, creates a flame-like effect. The upper portion 124 of the housing 120 preferably has an opaque coating that makes it less visible when viewed through the base 110. Alternatively, the upper portion 124 of the housing 120 maybe a separate part that is attached to the lower portion 122.

The lid 112 contains the electronics 126 that control the LEDs 114, 116 and 118 such that they flicker independently of one another. A rechargeable battery 128 that is used to provide power to the light is also contained within the lid 112. The battery 128 is recharged by a solar panel 130 that is mounted on the top of the lid 112. A CDS light sensor 132 is positioned on the lid 112 next to the solar panel 130. The light sensor 132 turns the light off at dawn and on at dusk such that power is conserved during the day light hours when the solar panel 130 is charging the battery 128. The LEDs 114, 116 and 118 are particularly useful in a solar powered embodiment such as shown in FIG. 5 due to their very low power consumption. The base 110 of the light has windows (not shown) in the sides through which the LEDs 114, 116 and 118 can be viewed. The windows are preferably frosted to further make the LEDs 114, 116 and 118 appear like a single light source that is flickering like the flame of a candle.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A lighting device for producing a light that simulates the flicker of a candle flame, said lighting device comprising:

at least a first, second and third light source wherein the light sources are arranged in an approximately vertical stack such that the first light source is lower in the vertical stack than the second light source and the second light source is lower in the vertical stack than the third light source;

a power circuit associated with each of said light sources for producing a power signal for its associated light source wherein the duty cycle of the power signal provided to the first light source is greater than the duty cycle of the power signal provided to the second light source and the duty cycle of the power signal provided to the third light source is less than the duty cycle of the power signal provided to the second light source and wherein the duty cycle of one power signal is independent of the duty cycle of the other power signals.

2. The lighting device of claim 1 further comprising a semi-transparent housing for enclosing the light sources wherein the transparency of the housing is such that the light from the individual light sources is visible but the individual light sources themselves are not.

3. The lighting device of claim 1 wherein the power circuits for the second and third light sources include a resistor and a capacitor such that a resistance value of the resistor and a capacitance value of the capacitor determine a frequency at which the power signal produced by the respective power circuit oscillates.

4. The lighting device of claim 1 wherein the power circuits for the second and third light sources include a diode that alters the duty cycle of the power signals produced by the power circuits.

5. The lighting device of claim 1 further comprising a light sensor for turning the lighting device on when an intensity of the light detected by the light sensor falls below a predetermined level.

6. The lighting device of claim 1 wherein the lighting device is powered by a solar battery that is recharged by a solar power source.

7. The lighting device of claim 1 wherein the duty cycle of the power signal provided to the first light source is such that the first light source is always on.

8. The lighting device of claim 1 further comprising a container for containing the lighting device wherein the container has a base and a lid and wherein the lighting device is attached to the lid.

9. A light that produces a light having a candle-like flicker, said light comprising:

a first light source positioned at a bottom of a vertical stack;

a second light source positioned in the vertical stack above said first light source;

a third light source positioned in the vertical stack above said second light source;

a first power circuit for producing a first power signal and providing said first power signal to said first light source;

a second power circuit for producing a second power signal having a duty cycle less than a duty cycle of said first power signal and providing said second power signal to said second light source; and a third power circuit for producing a third power signal having a duty cycle less than said second power signal and providing said third power signal to said third light source;

wherein said second and said third power circuits have at least one resistor and one capacitor and a frequency of the power signal produced by the second and third power circuits is determined at least in part by its respective resistor and capacitor.

10. The light of claim 9 further comprising a translucent housing shaped like a candle flame that contains the first, second and third light sources.

11. The light of claim 9 wherein the first, second and third light sources further comprise light emitting diodes.

12. The light of claim 9 further comprising a solar panel and a rechargeable battery for providing power for the light.

13. The light of claim 9 further comprising a light sensor for turning the light on when a detected light intensity falls below a predetermined level.

14. The light of claim 9 wherein the second power circuit and the third power circuit further comprise a diode that alters the duty cycle of the respective power signals produced by the second and third power circuits.

15. The light of claim 9 wherein the duty cycle and frequency of the second power signal is independent of the duty cycle and frequency of the third power signal.

16. The light of claim 9 further comprising an outer housing having a base and a lid wherein components of the light are incorporated into the lid and the lid is configured to attach to the top of the base.

17. A method of producing a light having a candle-like flicker, said method comprising:

arranging multiple light sources into an approximately vertical stack;

generating a relatively high duty cycle power waveform and providing said high duty cycle waveform to a lowest light source in said vertical stack;

generating an intermediate duty cycle waveform and providing said intermediate duty cycle waveform to a light source positioned in an intermediate location in said vertical stack;

generating a relatively low duty cycle waveform and providing said relatively low duty cycle waveform to a highest light source in said vertical stack;

wherein the duty cycle and frequency of said high duty cycle waveform, said intermediate duty cycle wave form and said low duty cycle waveform are independent of one another.

18. The method of claim 17 further comprising housing said multiple light sources in a translucent housing such that individual ones of said multiple light sources are not easily distinguishable through said housing.

19. The method of claim 17 wherein the steps of generating an intermediate duty cycle waveform and generating a relatively low duty cycle waveform further comprise setting an oscillation frequency of said intermediate duty cycle waveform and said relatively low duty cycle waveform with a resistive and capacitive circuit.

20. The method of claim 17 further comprising the step of using a diode to set a duty cycle of at least one of said waveforms.

21. The method of claim 17 further comprising the step of powering said light with a solar panel and associated rechargeable battery.

22. The method of claim 17 further comprising the step of turning off said light if a detected light intensity exceeds a predetermined level.

23. A device for producing a light having a candle like flicker, said device comprising:

a first light source oscillating between an off and an on state and a second light source oscillating between an on and an off state, wherein the oscillation of the first light source is independent of the oscillation of the second light source; and a fixture having a lid and a base wherein the light sources are positioned within a semi-transparent lower portion of a housing, an upper portion of the housing being attached to the lid and oscillation circuitry is contained in the lid and the lid is adapted to be attached to the top of the base.

24. The device of claim 23 wherein the first light source and the second light source are positioned within approximately one half inch of one another.

25. A device for producing a light having a candle like flicker, said device comprising:

a first light source that is in a visibly on state;

a second light source visibly oscillating between an on and an off state; and a third light source visibly oscillating between an on and an off state;

wherein the oscillation of the second light source is independent of the oscillation of the third light source.

26. The device of claim 25 wherein the first light source and the second light source are positioned within approximately one half inch of one another and the second light source and the third light source are positioned within approximately one half inch of one another.

27. The device of claim 25 wherein the first light source is positioned below the second light source and the second light source is positioned below the third light source.

28. The device of claim 27 wherein the third light source oscillates at a rate faster than the rate of oscillation of the second light source.

29. The device of claim 27 wherein the third light source oscillates with a duty cycle that is less than a duty cycle of the second light source.

* * * * *